US010260026B2

(12) United States Patent
Coburn et al.

(10) Patent No.: US 10,260,026 B2
(45) Date of Patent: Apr. 16, 2019

(54) METHOD FOR DISSOLUTION OF POLYMERIZED SOIL

(71) Applicant: Dow Global Technologies LLC, Midland, MI (US)

(72) Inventors: Charles E. Coburn, Vernon Hills, IL (US); William C. Miles, Collegeville, PA (US)

(73) Assignee: Dow Global Technologies LLC, Midland, MI (US)

( * ) Notice: Subject to any disclaimer, the term of this patent is extended or adjusted under 35 U.S.C. 154(b) by 20 days.

(21) Appl. No.: 15/518,123

(22) PCT Filed: Oct. 16, 2015

(86) PCT No.: PCT/US2015/055880
§ 371 (c)(1),
(2) Date: Apr. 10, 2017

(87) PCT Pub. No.: WO2016/064665
PCT Pub. Date: Apr. 28, 2016

(65) Prior Publication Data

US 2017/0313960 A1 Nov. 2, 2017

Related U.S. Application Data

(60) Provisional application No. 62/066,501, filed on Oct. 21, 2014.

(51) Int. Cl.

| | |
|---|---|
| ***C11D 3/43*** | (2006.01) |
| ***C11D 7/06*** | (2006.01) |
| ***C11D 7/50*** | (2006.01) |
| ***B08B 3/04*** | (2006.01) |
| ***C11D 7/26*** | (2006.01) |
| ***C11D 11/00*** | (2006.01) |

(52) U.S. Cl.
CPC ..... *C11D 7/261* (2013.01); *C11D 7/06* (2013.01); *C11D 7/5022* (2013.01); *C11D 11/0023* (2013.01); *C11D 11/0029* (2013.01); *C11D 7/262* (2013.01); *C11D 7/263* (2013.01)

(58) Field of Classification Search
CPC ..... C11D 3/044; C11D 3/2006; C11D 3/43; C11D 7/06; C11D 7/261; C11D 7/50; B08B 3/04
See application file for complete search history.

(56) References Cited

U.S. PATENT DOCUMENTS

| | | | | |
|---|---|---|---|---|
| 3,708,429 A * | 1/1973 | Hall et al. | ..... | C11D 3/0047 252/193 |
| 5,977,042 A * | 11/1999 | Hernandez | ..... | C11D 1/06 510/201 |
| 7,964,547 B2 | 6/2011 | Underwood et al. | | |
| 8,222,196 B2 | 7/2012 | Smith et al. | | |
| 8,246,696 B2 | 8/2012 | Man et al. | | |

FOREIGN PATENT DOCUMENTS

| | | | | |
|---|---|---|---|---|
| CH | 703228 B1 | 12/2011 | | |
| DE | 102011082136 * | 3/2013 | ..... | C11D 1/72 |
| DE | 102011082136 A1 | 3/2013 | | |
| WO | 2011041837 A1 | 4/2011 | | |

* cited by examiner

*Primary Examiner* — Brian P Mruk

(57) ABSTRACT

A method for removing polymerized soil by adding to the soil a composition which includes: (a) from 4 to 30 wt % of a hydroxide or alkoxide, (b) from 10 to 96 wt % of a $C_1$-$C_{12}$ primary alcohol; and (c) from 0 to 75 wt % of an organic solvent which is not a $C_1$-$C_{12}$ primary alcohol; wherein the composition contains no more than 40 wt % water.

9 Claims, No Drawings

METHOD FOR DISSOLUTION OF POLYMERIZED SOIL

This application claims benefit to Provisional Application Serial No. 62/066,501, filed on Oct. 21, 2014.

BACKGROUND

This invention relates generally to a method for dissolution of polymerized soil, especially residue from unsaturated triglycerides.

Cleaners which claim to be effective in removal of polymerized triglycerides have been reported, e.g., in U.S. Pat. No. 8,246,696. However, known cleaning products do not remove polymerized triglycerides efficiently. A composition capable of removing polymerized triglycerides quickly would be a desirable product.

STATEMENT OF INVENTION

The present invention is directed to a method for removing polymerized soil; said method comprising adding to the soil a composition which comprises: (a) from 4 to 30 wt % of a hydroxide or alkoxide, (b) from 10 to 96 wt % of a $C_1$-$C_{12}$ primary alcohol; and (c) from 0 to 75 wt % of an organic solvent which is not a $C_1$-$C_{12}$ primary alcohol; wherein the composition contains no more than 40 wt % water.

DETAILED DESCRIPTION

All percentages are weight percentages, and all temperatures are in ° C., unless otherwise indicated. Operations are performed at room temperature (20-25° C.) unless otherwise indicated. "Triglycerides" are natural fats or oils comprising glycerine triesters of fatty acids. Preferably, triglycerides are in the form of vegetable oils. Fatty acids are acyclic aliphatic carboxylic acids containing from 8 to 22 carbon atoms; typically, they contain from 12 to 22 carbon atoms. In most natural triglycerides, at least 95% of the fatty acid residues have from 16 to 18 carbon atoms. With respect to carbon-carbon bonds, the fatty acids may be saturated, monounsaturated or polyunsaturated (typically 2 or 3 carbon-carbon double bonds). Preferably, the polymerized soil is an oxidation product of a triglyceride comprising esterified polyunsaturated fatty acids, especially those having some esterified fatty acids with two non-conjugated double bonds. Preferred triglycerides include soybean oil, corn oil, sunflower oil, canola oil, hempseed oil, flaxseed oil, peanut oil, safflower oil, cottonseed oil and palm oil. Particularly preferred triglycerides include soybean oil, corn oil, sunflower oil, canola oil and safflower oil. The triglyceride can be isolated from naturally occurring seed sources or from genetically modified seed sources which may have enhanced levels of certain fatty acids, e.g., monounsaturated fatty acids or conjugated polyunsaturated fatty acids. A "glycol" is an aliphatic compound having two hydroxyl groups, preferably ethylene glycol, propylene glycol or oligomers thereof. An "organic solvent" is a compound or mixture of compounds that is liquid at 25° C. and 101 kPa, and contains no elements other than carbon, hydrogen and oxygen, except for trace levels of impurities.

Preferably, the soil is a triglyceride which has been polymerized by oxidation at high temperatures, such as those encountered in a deep fryer. Preferably, the polymerization occurred at a temperature of at least 250° C., preferably at least 300° C.

Preferably, the hydroxide or alkoxide is a salt of an alkali metal ion, ammonium hydroxide or tetraalkylammonium hydroxide or alkoxide, preferably sodium or potassium hydroxide or alkoxide, preferably potassium hydroxide or alkoxide. Preferred alkoxides include methoxide, ethoxide, propoxide and butoxide; preferably methoxide, ethoxide, n-propoxide and n-butoxide; especially methoxide and ethoxide. Preferably, component (a) is a hydroxide, preferably sodium or potassium, preferably potassium. Weights of hydroxides or alkoxides are on an "as is" basis, i.e., including any water present in commercial solid products. The composition may contain more than one hydroxide or alkoxide. Preferably, the composition comprises at least 5 wt % hydroxide or alkoxide, preferably at least 6 wt %, preferably at least 7 wt %, preferably at least 8 wt %; preferably no more than 25 wt %, preferably no more than 20 wt %, preferably no more than 15 wt %.

A $C_1$-$C_{12}$ primary alcohol is an alcohol having a $C_1$-$C_{12}$ hydrocarbyl chain containing no oxygen atoms. Preferably, the $C_1$-$C_{12}$ primary alcohol is limited to a $C_1$-$C_8$ primary alcohol; preferably methanol, ethanol, n-propanol, n-butanol, isobutanol, n-pentanol, isoamyl alcohol, n-hexanol, 2-ethylhexanol, 3-cyclohexene-1-methanol, hydroxymethylcyclohexane, 6-methyl-3-cyclohexene-1-methanol or benzyl alcohol; preferably methanol, ethanol, n-propanol, n-butanol or benzyl alcohol; preferably methanol, ethanol or benzyl alcohol; preferably methanol or ethanol. Combinations of alcohols may be used. When ethanol is used, it may be in the form of a 95% ethanol/5% water mixture and/or contain small amounts of denaturants such as methanol, toluene, methyl isobutyl ketone, etc. Preferably, the composition comprises at least 20 wt % $C_1$-$C_{12}$ primary alcohol, preferably at least 25 wt %, preferably at least 30 wt %, preferably at least 35 wt %, preferably at least 40 wt %; preferably no more than 92 wt %, preferably no more than 90 wt %, preferably no more than 85 wt %, preferably no more than 80 wt %, preferably no more than 75 wt %, preferably no more than 70 wt %, preferably no more than 65 wt %. In a preferred embodiment of the invention, the primary alcohol may be added to the composition partially or completely in the form of an alkoxide.

Preferably, the organic solvent is a glycol, glycol ether (including oligomers of ethylene oxide and/or propylene oxide) or ester; preferably a glycol mono-ether having at least a three-carbon alkyl group. Mixtures of solvents may be used. Preferably, the organic solvent is aliphatic. Preferably, the organic solvent is not an alcohol. Preferably the organic solvent has from 5 to 22 carbon atoms; preferably at least 6 carbon atoms, preferably at least 7 carbon atoms, preferably at least 8 carbon atoms; preferably no more than 18 carbon atoms, preferably no more than 16 carbon atoms, preferably no more than 14 carbon atoms. Preferably, the organic solvent has at least one oxygen atom, preferably at least two. The organic solvent may contain water, but preferably the water content of the entire composition is no more than 35 wt %, preferably no more than 30 wt %, preferably no more than 25 wt %, preferably no more than 20 wt %, preferably no more than 15 wt %, preferably no more than 10 wt %, preferably no more than 5 wt %. Preferably, the composition comprises at least 5 wt % organic solvent, preferably at least 10 wt %, preferably at least 15 wt %, preferably at least 20 wt %, preferably at least 25 wt %, preferably at least 30 wt %; preferably no more than 70 wt %, preferably no more than 65 wt %, preferably no more than 60 wt %, preferably no more than 55 wt %.

In one preferred embodiment of the invention, the primary alcohol(s) also acts as a solvent and the composition comprises from 4 to 30 wt % of a hydroxide or alkoxide and from 70 to 96 wt % of a $C_1$-$C_{12}$ primary alcohol. Preferably, the composition comprises at least 5 wt % hydroxide or alkoxide, preferably at least 6 wt %, preferably at least 7 wt %, preferably at least 8 wt %; preferably no more than 25 wt %, preferably no more than 20 wt %. Preferably, the composition comprises at least 75 wt % $C_1$-$C_{12}$ primary alcohol, preferably at least 80 wt %; preferably no more than 95 wt %, preferably no more than 94 wt %, preferably no more than 93 wt %, preferably no more than 92 wt %.

EXAMPLES

Soybean oil was held at a temperature of 350° C. for 24 hours in a 3-4 mm layer on an aluminum pan. The resulting soil was an orange-brown material with a rubbery consistency. The cleaning compositions described below were contacted with the soil at ambient temperature and the results are recorded in the table. Experiments below the double line are comparative.

| alcohol/wt % | base/wt % | solvent/wt % | result |
|---|---|---|---|
| methanol/47 | KOH/7 | ethyl laurate/47 | removed soil in 13 min |
| methanol/47 | KOH/7 | DOWANOL DPnB/47 | removed soil in 18 min |
| ethanol/56 | KOH/6 | DOWANOL DPnB/39 | removed soil in 30 min |
| ethanol/87 | KOH/13 | none | removed soil in 15 min |
| benzyl alcohol/85 | KOH/6 | water/9 | removed soil in 1 h (10 min @ 65° C.) |
| methanol/47 | KOH/7 | water/47 | soil was not removed in 24 h |
| methanol/47 | KOH/7 | none, CTAC/47 | soil was removed after 2 h |
| isopropanol/47 | KOH/7 | water/47 | soil was removed after 2 h |
| isopropanol/47 | KOH/7 | none, CTAC/47 | soil was removed after 2 h |
| none | KOH/7 | ethyl laurate/47, CTAC/47 | soil was not removed in 24 h |
| isopropanol/47 | KOH/7 | ethyl laurate/47 | soil was removed after 2 h |
| methanol/4 | KOH/7 | ethyl laurate/47, CTAC/43 | precipitate-did not remove soil |
| methanol/50 | none | ethyl laurate/50 | soil was not removed in 24 h |
| none | DMDA/50 | DOWANOL DPnB/50 | soil was not removed in 24 h |
| methanol/4 | KOH/7 | DOWANOL DPnB/89 | soil partially removed in 24 h |
| isopropanol/62 | KOH/5 | DOWANOL DPnB/33 | soil was removed after 2 h |
| none | NaOEt/23 | DOWANOL DPnB/77 | not soluble, soil not removed |

-continued

| alcohol/wt % | base/wt % | solvent/wt % | result |
|---|---|---|---|
| PG/67 | KOH/4 | DOWANOL DPnB/28 | soil was not removed in 24 h |
| PG/51 | KOH/6 | DOWANOL DPnB/43 | soil was not removed in 24 h |
| DEG/59 | KOH/5 | DOWANOL DPnB/36 | soil was not removed in 24 h |
| methanol/4, DEG/57 | KOH/5 | DOWANOL DPnB/34 | soil was not removed in 24 h |
| methanol/3, DEG/57 | KOH/5 | ethyl laurate/35 | soil was not removed in 24 h |
| n-octanol/78 | KOH/3 | DOWANOL DPnB/19 | soil was not removed in 24 h |

DOWANOL DPnB is dipropylene glycol mono-butyl ether;
CTAC is cetyl trimethylammonium chloride;
DMDA is N,N-dimethyldecylamine;
NaOEt is sodium ethoxide;
DEG is diethylene glycol

The invention claimed is:

1. A method for removing polymerized soil; said method comprising adding to the soil a composition which comprises: (a) 6 to 30 wt % of a hydroxide or alkoxide, (b) from 10 to 96 wt % of a $C_1$-$C_{12}$ primary alcohol; and (c) from 0 to 75 wt % of an organic solvent which is not a $C_1$-$C_{12}$ primary alcohol; wherein the composition contains no more than 40 wt % water; wherein the soil is a triglyceride which has been polymerized by oxidation at a temperature at least 250° C.

2. The method of claim 1 in which the composition contains no more than 30 wt % water.

3. The method of claim 2 in which the composition comprises from 30 to 95 wt % of a $C_1$-$C_{12}$ primary alcohol.

4. The method of claim 3 in which the composition comprises from 5 to 20 wt % of a hydroxide or alkoxide.

5. The method of claim 4 in which the composition comprises from 20 to 60 wt % of said organic solvent.

6. The method of claim 4 in which the composition comprises no more than 15 wt % water.

7. The method of claim 4 in which the composition comprises from 80 to 95 wt % of a $C_1$-$C_{12}$ primary alcohol.

8. The method of claim 1 in which the $C_1$-$C_{12}$ primary alcohol is methanol, ethanol, n-propanol, n-butanol, isobutanol, n-pentanol, n-hexanol, 2-ethylhexanol, 3-cyclohexene-1-methanol, hydroxymethylcyclohexane, 6-methyl-3-cyclohexene-l-methanol or benzyl alcohol.

9. The method of claim 8 in which the composition comprises no more than 15 wt % water.

* * * * *